United States Patent [19]

Ray

[11] Patent Number: 4,833,953

[45] Date of Patent: May 30, 1989

[54] NOTCHING METHOD AND APPARATUS FOR FABRICATION OF GARMENT GOODS

[75] Inventor: Ted M. Ray, McKinney, Tex.

[73] Assignee: Levi Strauss & Co., San Francisco, Calif.

[21] Appl. No.: 944,750

[22] Filed: Dec. 22, 1986

[51] Int. Cl.[4] ..... A41H 9/00; B26D 3/12; D06H 1/00

[52] U.S. Cl. ..... 83/14; 83/23; 83/39; 83/155; 83/210; 83/213; 83/282; 83/527; 83/613; 83/901; 112/121.15; 112/131

[58] Field of Search ..... 83/901, 917, 368, 370, 83/639, 692, 461, 558, 560, 562, 563, 13, 14, 39, 209–211, 213, 282, 527, 409, 152, 155, 23; 29/407; 112/121.15, 131

[56] References Cited

U.S. PATENT DOCUMENTS

| | | | |
|---|---|---|---|
| 1,962,024 | 6/1934 | Mann | 164/17.5 |
| 2,127,326 | 8/1938 | Cohen | 164/19 |
| 2,437,662 | 3/1948 | Hadley | 112/2 |
| 2,472,862 | 6/1949 | Sigoda | 83/902 |
| 3,483,781 | 12/1969 | Critides et al. | 83/370 |
| 3,752,027 | 8/1973 | Gerber et al. | 83/613 |
| 4,175,681 | 11/1979 | Scholl et al. | 223/2 |
| 4,243,314 | 1/1981 | Bowe et al. | 83/560 |

*Primary Examiner*—Frank T. Yost

*Assistant Examiner*—Hien H. Phan

*Attorney, Agent, or Firm*—Limbach, Limbach & Sutton

[57] ABSTRACT

Method and apparatus for automatically providing notching indicia on the edge of a garment subassembly to provide a dimensional reference to be utilized in subsequent fabrication of the goods. A conveyor transports the garment subassembly to a notching station at which the pre-assembled parts are secured in accurate registration to the path of a notching device that is movable on a carriage toward and away from the notching station. The notching device includes a vertically extending notching blade having a recessed cutting edge which, when positioned at the notching station, overlies an edge of the garment part subassembly. On displacing the blade downward, the notch indicia is cut into the garment piece after which the notching unit is withdrawn to a home position while the notched part is transported by the conveyor to a subsequent fabrication step. In a preferred embodiment two notching devices supported in a common path on opposite sides of the notching station are utilized. The two separate notching devices are selectively operated for notching a garment subassembly relative to the orientation of the subassembly in the finished fabricated garment goods. The carriage is motor driven to move the notching units to and from the notching station in timed relation to the securement of subassembly garment goods thereat.

14 Claims, 3 Drawing Sheets

TRANSFER PULL-REGISTRATION & REGISTRATION

NOTCHING METHOD AND APPARATUS FOR FABRICATION OF GARMENT GOODS

TECHNICAL FIELD

The technical field to which the invention relates comprises the field of garment manufacture and specifically to method and apparatus for providing notching indicia to garment parts during the course of manfacture to be used as a dimensional reference for maintaining quality control in the finished garment or garment subassembly.

BACKGROUND OF THE INVENTION

In the manufacture or fabrication of garment of goods such as men's pants, the parts are secured to each other in a controlled sequence forming subassemblies until the entire garment is ultimately completed. Each such subassembly is of course subject to manufacturing tolerances. Unless the tolerances are carefully controlled, the end product can contain cumulative tolerances of the various subassemblies which adversely reflects on the quality control of the finished goods sought to be maintained.

In the garment industry it has been known for example to hand pre-notch pocket facing material such as denim in the cutting room to form an indicia for subsequent assembly of the liner to be sewn thereto. This has proved not only labor intensive but also unreliable and highly inaccurate in relying on manual compensations for overcoming error to control manufacturing tolerances. Automatic manfacture on the basis of manual pre-notching has also proved unsatisfactory because of a general inability to maintain tolerances and consequent quality control in the finished product.

In the case of pocket fabrication, the liner cloth is attached to the facing material for forming a subassembly that is to be attached subsequently to a side seam or side edge of the pant panel. The liner is folded about a center line from a flat sheet to effect a bag shape into which the normal pocket contents of the finished pant when worn will ultimately be placed. If the hand applied notch has not been accurately positioned, not only are the liner and facing material subject to misalignment, but subsequent attachment of the subassembly can compound the problem by compounding the tolerances necessary to be controlled in the manufacture of quality merchandise. Various mechanisms to effect notching indicia are disclosed for example in U.S. Pat. Nos. 2,127,326; 2,437,662 and 3,752,027.

SUMMARY OF THE INVENTION

This invention relates to method and apparatus for automatically providing accurate notching indicia to garment goods for serving as a dimensional reference in the subsequent automatic fabrication of the goods. Unlike the prior art approaches of pre-notching by hand or machine, the method and apparatus hereof effect automatic notching as a post-assembly step by placement of the notch at a measured location on the subassembly independent of tolerances previously maintained in the prior subassembly fabrication of such parts. Being that the notch is positionally dimensioned with precision and which can be varied in correlation to the wear size of the finished product, the subassembly can progress through the next and subsequent fabrication step with dependability of dimensional control. The end result is a final garment product of high dimensional quality consistent with the quality reputation of the manufacturer. In the case of the pocket subassembly, the notch is precisely placed at a site on the side seam of the pocket so as to correspond to a set dimension from the recipient garment part to which it will subsequently be attached.

In accordance with an important aspect of the invention, the garment goods to be notched includes at least one previously conducted subassembly and is conveyed on a support surface to a notching station where by means of sensor units it is positively secured accurately in place. While the goods are secured thereat, the notching apparatus hereof is advanced in a path having a predetermined registration with the notching station extending laterally therefrom. On arriving at an edge surface of the goods at the notching station, the notching apparatus is operative to notch cut the edges of the goods. Being that the path of the notching apparatus is in a predetermined registration with respect to the notching station, location of the notch by the notching apparatus is with regard to providing a precise dimensional indicia of the fabrication step or steps to follow. After notching is completed, the notching apparatus is withdrawn to its predetermined passive or "home" location while the notched garment subassembly is forwarded for subsequent fabrication while the cycle is repeated.

In another aspect of the invention, the precise travel advance of the notching apparatus to effect notching of the goods at the notching station can be varied in correlation to garment size for reducing notch apparatus cycle time in the indicia placement of such garment subassemblies.

In a still further important aspect of the invention, the notching apparatus is comprised of alinged units commonly supported and oppositely located with respect to the notching station for the garment subassembly. Each of the units is operated selectively for notching either right hand or left hand pocket subassemblies received respectively at the notching station.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 2:
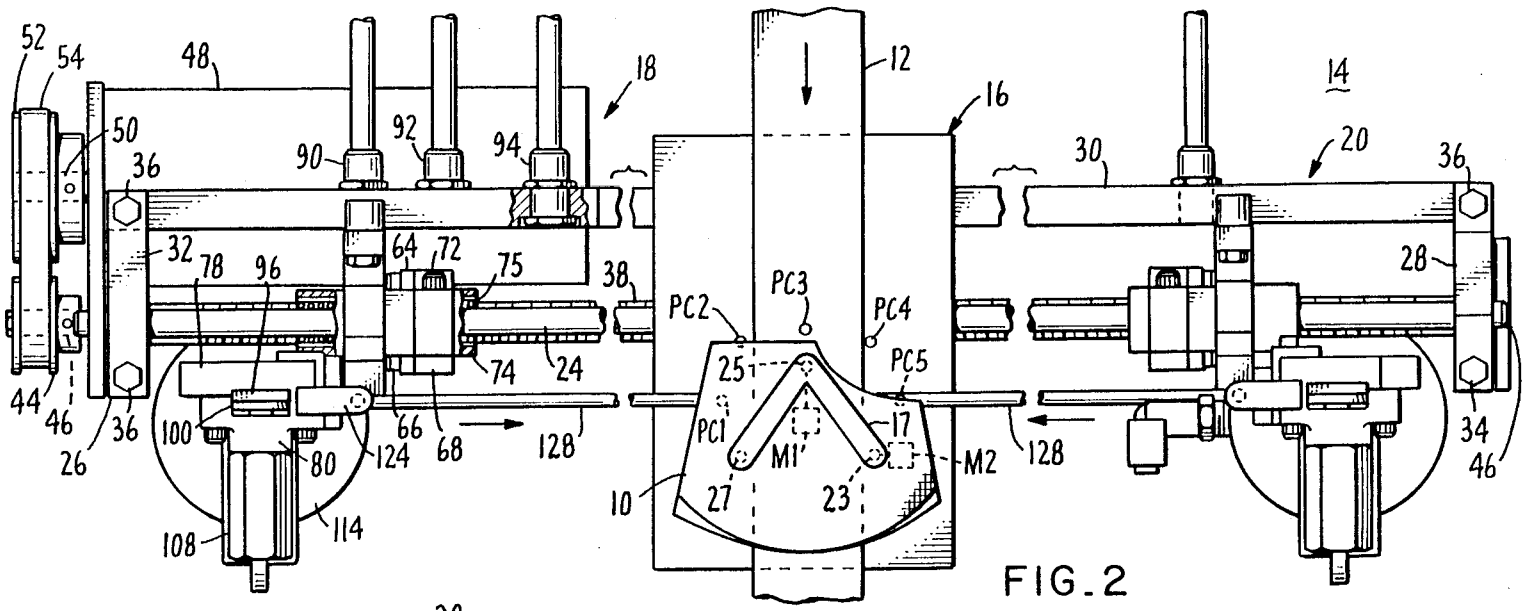
FIG. 2 is a plan view of a notching apparatus hereof.

In the description which follows, like parts are marked throughout the specification and drawings with the same reference numerals, respectively. The drawing figures are not necessarily to scale and in certain views parts may be drawn rotated into the plane of the drawing for purposes of clarity.

Figure 1:
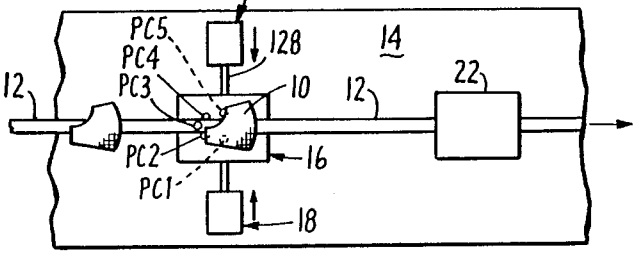
FIG. 1 is a schematic arrangement of a notching system in which the method and apparatus of the invention are utilized.
Figure 3:
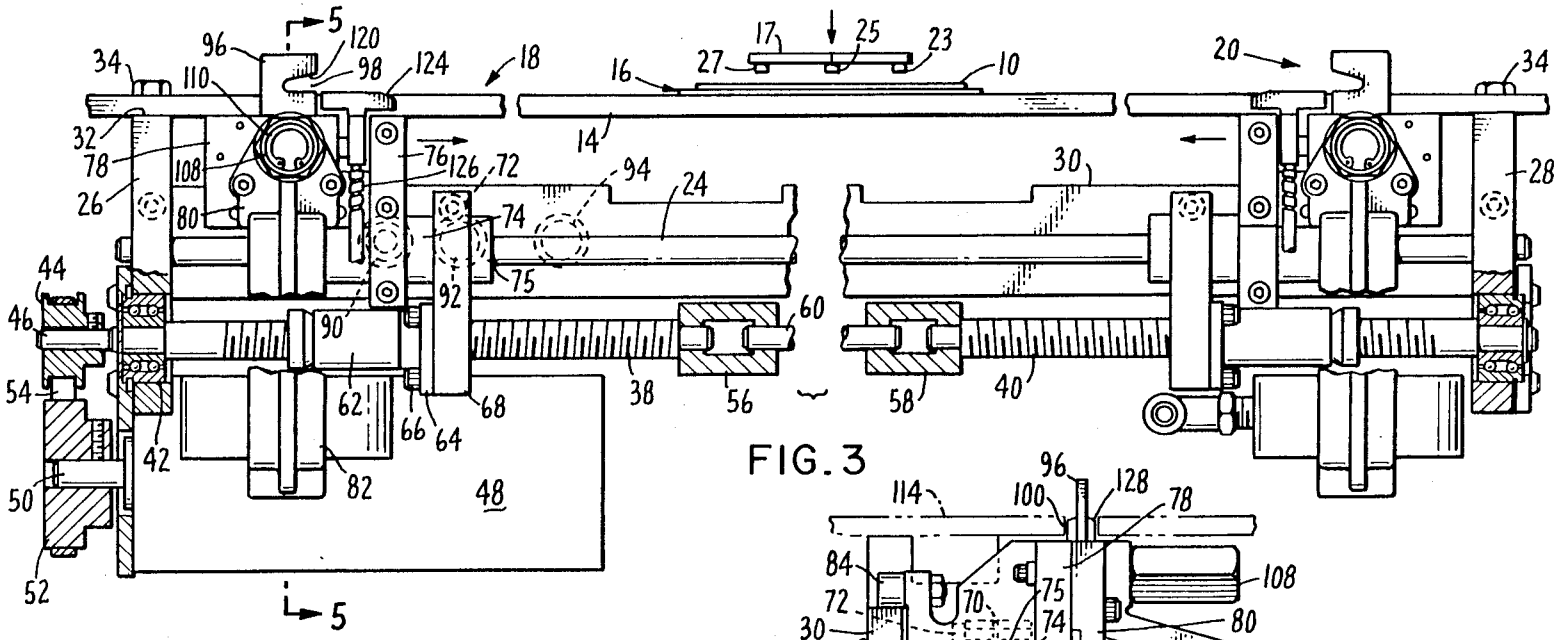
FIG. 3 is a side elevation of the notching apparatus of FIG. 2.

Referring first to FIG. 1, there is illustrated a schematic arrangement by which a garment part designated 10, and which for purposes of description comprises a pocket subassembly for men's pants, is supported and advanced on a vacuum conveyor belt 12. Advance of the part 10 is on the surface of a table 14 toward a notching station designated 16. The vaccum conveyor belt 12 and its associated drive system are of a conventional, well known construction, the belt 12, in the usual manner, passing along the upper side of the station 16 to carry the belt-transported garment part 10, which is vacuum-held on top of the belt, onto and across the station. At the notching station movement of the garment part 10 is caused to be arrested and positioned at a precise location (i.e., by stopping movement of the belt 12 in a conventional manner) in response to sensing the edges of arrived part 10 by means of a fiberoptic system (not shown) in communication with a plurality of spaced apart photocells P.C. 1-5. Once arrested, the part 10 is secured in place in registration to the manufacturing dimensions to be maintained by means of a pneumatically operable holddown clamp 17 (FIGS. 2 and 3). Situated on opposite sides of the notching station 16 for lateral movement toward and away therefrom are the commonly supported notching units 18 and 20 in accordance herewith as will be described. Both notching devices 18 and 20 are essentially of identical construction and similarly operable. For the specific purposes hereof, the notching units 18 and 20 are operative alternately for notching right and left hand pocket subassemblies in the fabrication of men's trousers. After notching has been completed following operation of one or the other of the notching devices at the notching station, the garment is released and advanced by conveyor 12 to a folding station 22 before subsequent processing. Concomitantly, the notching units 18 and 20 are returned to their home relation illustrated in the drawings.

To achieve proper positioning of part 10 at station 16 prior to notching, the illuminated and non-illuminated photocells P.C. 1-5 provide alignment signals to a computer control. In response to a computer determined misalignment, triangularly arranged and dependently supported gripper stoppers 23, 25 and 27 are extended down so as to engage and secure part 10. Via actuation of servo motors M-1 and/or M-2 the position setting of part 10 can be displaced in the X or Y axes respectively until arcuate registration is achieved. At such time, the gripper stoppers and vacuum (not shown) secure the garment part until indicia notching thereof is completed.

Referring now to FIGS. 2-5, there is shown the notching apparatus 18 and 20 it being understood that they are essentially identical in construction and operation and except where required for purposes of explanation only apparatus 18 will be described. It should be further understood that apparatus 20 is opposite hand with respect to unit 18.

Commonly supporting both notching units 18 and 20 is an elongated carriage rod 24 extending between upstanding end plates 26 and 28. Joining the two end plates 26 and 28 is an elongated mounting rail 30. Each of the end plates are in turn adapted to be secured along their upper surface 32 to the underside of table 14 via a pair of bolts 34 and 36. Extending parallel and beneath carriage rod 24 is a left handed lead screw 38 end supported in ball bearing 42 and joined via couplings 56 and 58 and stub shaft 60 to opposite right handed lead screw 40. The distal end 46 of lead screw 38 supports drive pulley 44. Rotation of the screw 38 is effected via a reversible DC motor 48 supporting on its output shaft 50 a pulley 52 connected via a timing belt 54 to pulley 44.

Figure 4:
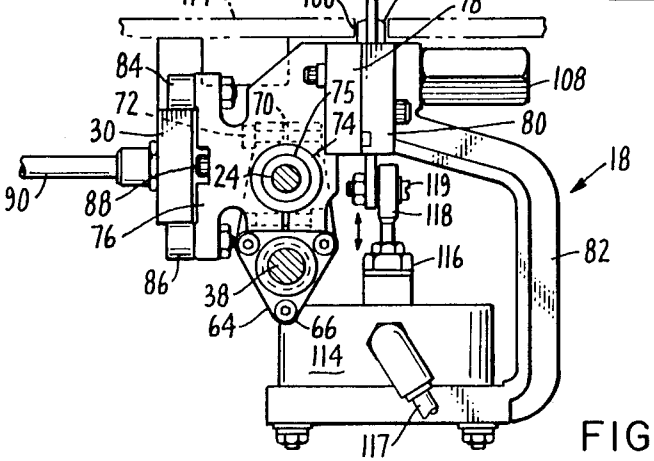
FIG. 4 is an end elevation of the notching apparatus of FIG. 2.

Drive for the lead screws for travel positioning of the supported carriages, as will be described, is transmitted via screw nut 62 (FIG. 3) having a triangular end flange 64 that is connected via bolts 66 to a vertical plate 68. Plate 68 includes a split end 70 (FIG. 4) enabling the plate to be clamped via bolt 72 to the exterior sleeve 74 of Thompson slide bearing 75. Also, secured to outer sleeve 74 of bearing 75 is a vertical mounting plate 76 to which is laterally connected a substantially rectangular block 78 in turn connected to the face of block 80 comprising the upper end of vertical bracket yoke 82. Providing rolling support for block 78 are roller followers 84 and 86 engaging the topside and underside surfaces respectively of mounting rail 30 (FIG. 4). Mounted in plate 76 is a magnetic sensor 88 adapted to cooperate with one of the Hall effect proximity switches 90, 92 or 94 for setting the home position of the notch units as will be explained.

To effect the notching of a garment part 10 received at station 16 motor 48 is first operative to concomitantly drive lead screws 38 and 40 for advancing the carriages of units 18 and 20 relatively toward each other until arriving oppositely juxtaposed at notching station 16. Within sensor brackets 124 of units 18 and 20 respectively are the photocell sensors P.C. 1 and P.C. 5 which sense the edge presence of right and left hand pocket parts 10 respectively. When the units 18 and 20 are moved to their operative positions on opposite sides of notching station 16, the photo cell sensors P.C. 1 and P.C. 5 carried by sensor brackets 124 are moved to the positions on the notching station 16 as indicated in FIGS. 1 and 2.

Figure 5:
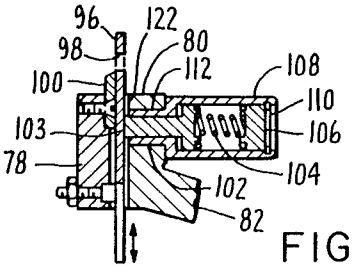
FIG. 5 is a fragmentary sectional view as taken substantially from the position 5—5 of FIG. 3.
Figure 6:
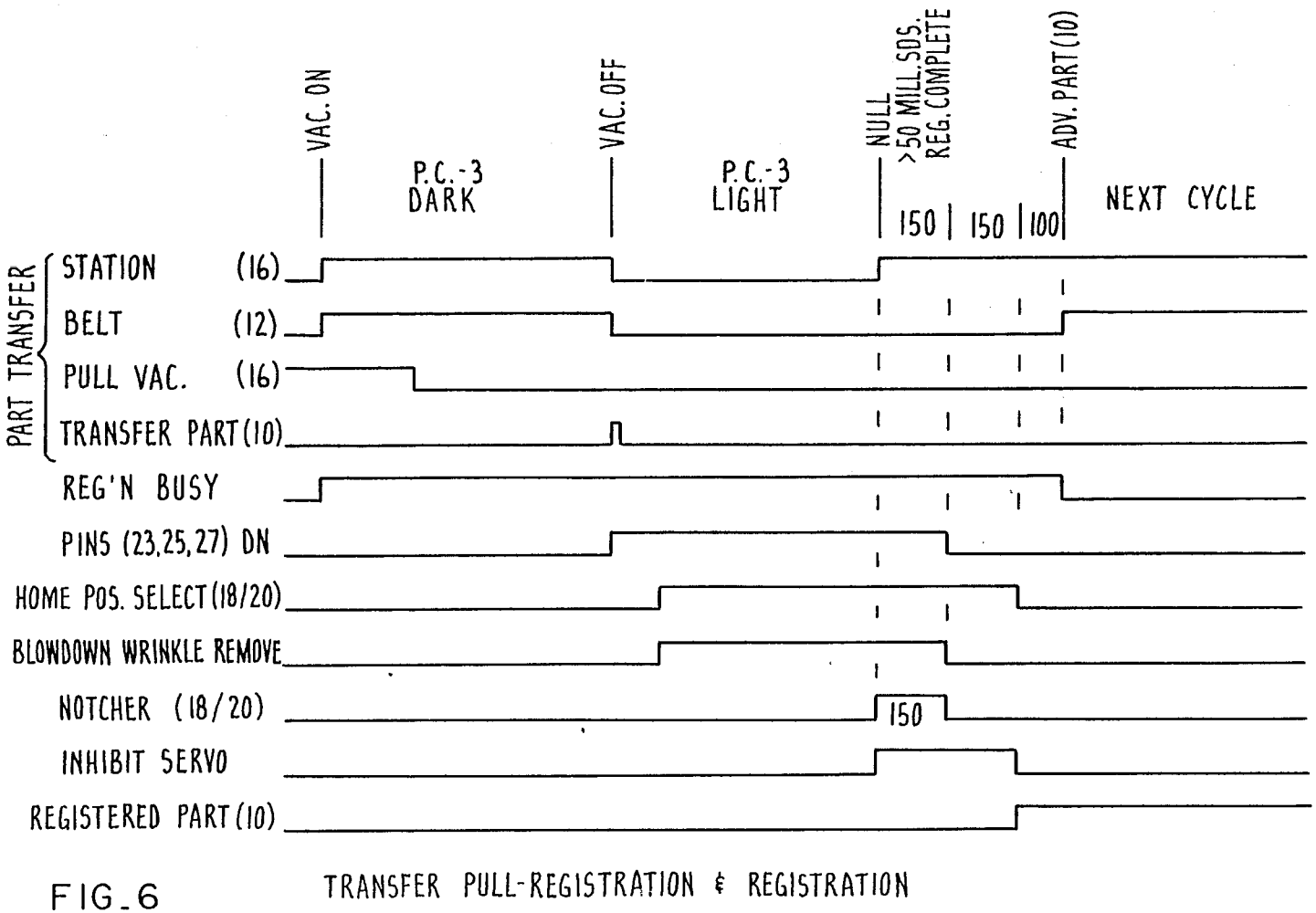
FIG. 6 is a timing chart for the operational sequences of the various components.

Supported on the carriage to effect the actual notch operation is an upstanding reciprocally operable elongated notching blade 96 having a knife notch 98. The blade is normally supported with notch 98 above the surface plane of table 14 in a table slot 128 extending laterally in dimensional registration with notching station 16. Containing blade 96 slidably secured in slot 122 is a stationary blade 100 and a resiliently biased pressure pin 102 urging blade 96 against blade 100 by means of a compressed coil spring 104 in a housing capsule 106 (FIG. 5). Maintaining the compression of spring 104 is a retainer plug 106 and a spring retainer clip 110. A sleeve 112 threadedly connected to block 80 provides for sliding movement of the rod portion of pin 102 enabling the rod end face 103 to maintain continuous contact against the displaceable side face of blade 96.

Notch cutting of a garment part 10 at station 16 for constituting the reference indicia is effected via blade 96 after being advanced by its supporting carriage to receive the edge of garment part 10 at station 16 within the notch cutout 98. Reciprocal displacement of blade 96 for that purpose is effected by means of a pneumatically actuated piston-cylinder 114 which via an adapter 116 and a rod end 118 is connected by means of bolt 119 to the under end of blade 96. As the blade is drawn downward, upper cutting edge 120 of notch 98 effects a cutting action against the entrained edge of part 10 after which the blade is reciprocated upward to the normal position illustrated for example in FIG. 3. Fiberoptics in tube 126 extending to a termination in bracket 124 communicates signals from photocell P.C. 1 for detecting absence or presence of a part 10 at station 16 to be notched for controlling operation of piston-cylinder 114.

In operation, the individual subassembly garments parts 10 are continually advanced seriatim by conveyor 12 over the surface of table 14 to the notching station 16 at which the optical sensors P.C. 2–5 in combination with stoppers 23, 25 and 27 effect registered positioning and arrested movement of the part at an accurate placed position thereon. Once the position of the part has been determined to be in registered alignment, holddown clamp 17, containing the dependent stoppers, functions to secure the part at the arrested position of the notching station. Thereafter, with the part 10 secured, motor 48 is energized whereby lead screws 38 and 40 are both rotated for simultaneously advancing the carriages of both units 18 and 20 toward the notching station with each blade 96 upstanding through table slot 128. By virtue of an advance signal transmitted to one or the other notching units a right hand or left hand pocket part 10 is identified as being present at the notching station. When the sensors P.C. 1 and/or P.C. 5 identify the presence of part 10 the respective pneumatic cylinder 114 of units 18 and 20 is actuated. This causes the attached notching blade 96 to be vertically withdrawn downwardly for the knife edge 120 thereof to notch the edge of the part 10 subassembly thereat. Immediately after notching is completed, the actuated blade 96 is restored upwardly to its normal position and both unit carriages are withdrawn to their home positions as determined by the selected Hall effect switches 90, 92 or 94 in response to magnetic sensor 88. The selection of the one Hall effect switch to be utilized is generally determined on the basis of the pocket size for the corresponding trouser size being notched at notching station 16. This enables the cycle time of the forward and return strokes of the carriage units to be controlled and thereby avoid unnecessary travel and wastage of operating time.

By the above disclosure, there is described novel method and apparatus for automatically providing accurate notching indicia to garment goods to serve as a dimensional reference for the subsequent automatic and/or non-automatic fabrication of the goods. Unlike prior approaches of prenotching by hand or machine, the method and apparatus hereof effects automatic notching as a post assembly step after an initial subassembly has been formed so as to enable a measured location for the indicia to be accurately provided in a registered position with respect to the dimensions of the garment to be maintained. Following notching, the notched garment part is automatically forwarded to a subsequent fabrication step such as folding by which the subassembly of the preferred embodiment can be subsequently sewn and attached to the side seam or side edge of the pant panel on the trouser being fabricated. The end result in accordance with the method and apparatus of the invention is a final product of continuous high dimensional quality consistent with the quality reputation of the manufacturer on which the buying public of such goods have come to rely.

The actual notching apparatus is reliably effective and readily controlled for determining the appropriate placement of the notch indicia in the course of translating from a home position to the notching relationship at the notching station. The virtues of the arrangement should be instantly apparent insofar as automated fabrication of such garment goods can be achieved with a highly consistent level of quality based on the indicia which the precision dimensionally related notching that the notching apparatus provides. By affording such accuracy, the previous inaccuracies and poor quality of finished product resulting from uncontrolled cumulative tolerances of dimension is eliminated thereby resolving a longstanding problem in the garment industry. Whereas notching devices 18 and 20 have been described as operative in the alternative, it is contemplated that they could be operative simultaneously where the application dictates.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A method of placing indicia on garment parts for providing a dimensional reference in the subsequent fabrication of the part toward a completed garment, said method comprising the steps of:

(a) preparing a subassembly of at least two garment parts secured together in an assembled relation;

(b) securing the prepared subassembly of garment parts at a notching station in a predetermined position relative to subsequent disposition of said subassembly for fabrication;

(c) disposing a notching device in a fixed position relative to an edge surface of the subassembly at said notching station;

(d) notching the edge of said subassembly with said notching device while the subassembly is secured at said notching station; and (e) providing support means defining a support surface, said notching station being defined by sensors positioned about said support surface for effecting the registration placement of the part subassembly thereat, said provided notching device being mounted on said support means and including a carriage for translated movement in a fixed path toward and away from said notching station and said step of notching said subassembly includes advancing said carriage to and from a notching relation with an edge of a garment subassembly at said notching station respectively before and after operating the notching device to notch the edge of the subassembly.

2. The method according to claim 1 in which two notching devices are provided oppositely aligned with respect to said notching station and the step of notching said subassembly includes selectively operating at least one of said notching devices in correlation to the finished orientation of the garment part subassembly on the fabricated garment goods when completed.

3. The method according to claim 2 in which said garment part subassembly comprises opposite hand component parts and the selective operation of said separate notching devices includes one notching device operable for notching a first hand part and the other notching device for notching an opposite hand part.

4. The method according to claim 3 in which said step of preparing a subassembly comprises providing a preassembled pocket facing and lining, said first hand part comprising a right hand pocket and said opposite hand part comprising a left hand pocket.

5. The method according to claims 1, 2 or 3 further including the step of advancing the garment part subassemblies to and from said notching station for supplying the subassemblies to and from said notching station for supplying the subassemblies seriatim to said registration relation at the notching station and said conveyor means is operative in timed relation to the operation of said notching device for supplying and removing subassemblies from said notching station.

6. A system for placing indicia on a garment part for providing a dimensional reference in the subsequent fabrication of the part toward a completed garment, said system comprising:

(a) a support surface having a notching station thereon;

(b) means at said notching station for securing a garment subassembly to receive a notch as indicia for the disposition of said garment subassembly in subsequent fabrication steps;

(c) a notching device mounted on said support means in a fixed position relative to said garment part subassembly secured at said notching station;

(d) means to actuate said notching device to operably place said indicia notch on said garment part subassembly secured at the notching station;

(e) means operative for advancing a garment subassembly to be notched to and from said notching station in timed relation to the actuation of said notching device; and (f) registration means contained about said support surface for defining the fixed position at said notching station at which a received garment subassembly is to be secured and said notching device includes drive means to effect translated movement thereof in a fixed path toward and away from said notching station.

7. A system according to claim 6 including means at said notching station to secure said garment part subassembly in said fixed position.

8. A system in accordance with claim 6 including two notching devices aligned with each other and oppositely positioned with respect to said notching station and there is included means for selectively operating at least one of said notching devices for the placing of the indicia in correlation to the finished orientation of the garment part subassembly on the fabricated garment goods when completed.

9. A system in accordance with claim 8 in which said drive means is commonly connected to both of said notching devices to effect concomitant translated movement thereof in a fixed path toward and away from said notching station.

10. A system in accordance with claim 8 in which the garment part subassembly comprises opposite hand component parts and the selective operation of said separate notching devices includes one notching device operable for notching a first hand part and the other notching device for notching an opposite hand part.

11. A system in accordance with claim 10 in which said garment part subassembly comprises a preassembled pocket facing and lining, said first hand part comprises a right hand pocket and said opposite hand part comprises a left hand pocket.

12. A notching apparatus for placing dimensionally related indicia on a garment part subassembly in the course of garment fabrication, said apparatus comprising:

(a) means for supporting said apparatus in a predetermined relation to a notching station at which the garment subassembly is disposed and notched;

(b) a notching unit having a notch blade positioned to overly an edge of said garment subassembly disposed at the notching station;

(c) actuating means to operate said notching unit in said overlying position to enable said blade to cut a notch into the underlying edge of the garment part subassembly; and (d) carriage means operative in a controlled travel path for advancing said notching unit to and from said overlying position, said carriage means including an elongated longitudinally extending lead screw, said notching apparatus further comprising means operative when energized to drivingly rotate said lead screw for effecting advance of said carriage means to and from said overlying relation at the notching station, and sensing means for initiating a knife cutting displacement of said blade when said blade of said notching unit incurs said overlying relation after said carriage means arrives at the notching station.

13. A notching apparatus in accordance with claim 12 including means to selectively vary the travel distance of said carriage to and from said overlying relation of said blade for controlling the timed operation of the carriage cycle.

14. A notching apparatus in accordance with claim 12 including piston means connected to said notching blade and operatively responsive to a signal from said sensing means when the notching blade is in said overlying relation to displace said blade across an edge of the garment subassembly for effecting said knife cutting displacement.

* * * * *

UNITED STATES PATENT AND TRADEMARK OFFICE

CERTIFICATE OF CORRECTION

PATENT NO. : 4,833,953

DATED : May 30, 1989

INVENTOR(S) : TED M. RAY

It is certified that error appears in the above-identified patent and that said Letters Patent is hereby corrected as shown below:

Column 1, line 15, "of" (second occurrence) should be deleted.

Column 2, line 36, "alinged" should read --aligned--.

Column 7, line 9, claim 5, "sassemblies" should read --assemblies--.

Signed and Sealed this

Third Day of April, 1990

*Attest:*

HARRY F. MANBECK, JR.

*Attesting Officer*

*Commissioner of Patents and Trademarks*